United States Patent [19]

Norton et al.

[11] 3,968,638

[45] July 13, 1976

[54] PRODUCT AND PROCESS

[75] Inventors: Lilburn Lafayette Norton; William Thomas Windley, both of Seaford, Del.

[73] Assignee: E. I. Du Pont de Nemours and Company, Wilmington, Del.

[22] Filed: June 9, 1975

[21] Appl. No.: 585,353

[52] U.S. Cl. ..... 57/140 R; 57/157 F

[51] Int. Cl.[2] ..... D02G 1/16; D02G 1/20; D02J 1/08

[58] Field of Search ..... 57/34 B, 34 HS, 34 R, 57/140 R, 157 R, 157 F, 157 TS

[56] References Cited

UNITED STATES PATENTS

| | | | |
|---|---|---|---|
| 3,309,855 | 3/1967 | Stoll et al. | 57/34 HS |
| 3,443,292 | 5/1969 | Davis | 57/157 F X |
| 3,460,213 | 8/1969 | Ensslin et al. | 57/34 B X |
| 3,460,336 | 8/1969 | Collingwood et al. | 57/34 B X |
| 3,593,514 | 7/1971 | Stanley | 57/157 TS |
| 3,611,698 | 10/1971 | Horn et al. | 57/140 R |
| 3,686,848 | 8/1972 | Miller et al. | 57/140 R |
| 3,708,970 | 1/1973 | MacFarlane | 57/140 R |
| 3,875,625 | 4/1975 | Blanc et al. | 57/157 F X |

FOREIGN PATENTS OR APPLICATIONS

| | | |
|---|---|---|
| 2,072,959 | 9/1971 | France |
| 1,804,525 | 6/1970 | Germany |
| 4,843,985 | 12/1973 | Japan |
| 848,037 | 9/1960 | United Kingdom |

*Primary Examiner*—Donald E. Watkins

[57] ABSTRACT

A cohesive yarn having latent twist, which is recoverable by relaxation of the yarn in heat and moisture, is composed of crimped and entangled continuous thermoplastic filaments. It provides good tuft definition and a lustrous appearance in pile fabric. Production of the yarn by hot jet-entangling crimped filaments throughout the length of a yarn bundle and heat-setting latent twist in the yarn bundle while false-twisted with an air-torque jet is illustrated.

11 Claims, 4 Drawing Figures

PRODUCT AND PROCESS

BACKGROUND OF THE INVENTION

The invention relates to cohesive bulky continuous filament yarn and its production, and is more particularly concerned with improved yarn for use as pile in pile fabrics, especially cut-pile carpets.

When carpet yarn is used in cut-pile carpet constructions known as shag and saxony, wherein each tuft must appear as a coherent yarn without excessive splaying of tuft ends in use, a single bulked yarn of continuous thermoplastic filaments has been twisted, wound on skeins, tumbled to develop crimp, heat-set in a steam autoclave and rewound from skeins to cones before being tufted into fabric to form the carpet. The process of twisting and heat-setting twist in the yarn is costly and reduces the bulk of the yarn. High twist is used to provide tufts having adequate coherency plus a lustrous twisted appearance due to substantial helical parallelism of the surface fibers. Such yarn has considerable torque and must be processed at high tension to avoid kinks which would obstruct delivery tubes and needles of tufting machines. Processing difficulties would, in turn, result in nonuniform tuft appearance. Without such twisting and heat setting the cut tuft ends expand until they tangle with neighboring ends, giving a high bulk but a matted appearance wherein individual tufts are indistinguishable.

Bulked yarns of highly entangled filaments have been prepared which have adequate coherency without twisting, to prevent excessive splaying of tuft ends, but such yarns have had a random crimped configuration in surface filaments which do not provide the appearance desired in shag or saxony rugs and have had protruding filament loops which make processing difficult.

SUMMARY OF THE INVENTION

The present invention provides coherent yarn of continuous thermoplastic multifilaments. The filaments have an average of at least 4 crimps per inch (158 per meter) when relaxed in heat and moisture, and are highly entangled throughout the length of the yarn. The yarn has a lateral coherency of 0.2 to 2.8 inches (0.5 to 7.1 centimeters) with a standard deviation of less than 0.5 times the average value when tested as defined subsequently. The yarn has a latent twist of 0.75 to 10 turns per inch (30 to 394 turns per meter) which is recoverable by relaxation of the yarn in heat and moisture. The yarn is readily processed into cut-pile fabric constructions without the difficulties which have been caused by torque or protruding filament loops. Recovery of the latent twist is accompanied by an increase in yarn bundle diameter. Bulky tufts are formed which have the appearance desired in shag or saxony carpets. The tufts are coherent, without excessive splaying of tuft ends in use, and have a lustrous surface.

The surface of the yarn is substantially free from protruding filament loops. There is less than an average of one crunodal (ring-like) filament loop per inch of yarn. There is also less than one filament loop of any kind per inch of yarn which protrudes from the surface more than 1/2 the bundle diameter when evaluated as described subsequently.

The lateral coherency of the yarn of this invention is preferably 0.8 to 2.0 inches (2.0 to 5.1 cm.). Preferably the uniformity of entanglement throughout the length of the yarn is such that the standard deviation of lateral coherency is less than 0.3 times the average value. The latent twist is preferably 2 to 6 turns per inch (79 to 236 turns/meter). The increase in yarn bundle diameter when twist is recovered after tufting is greater than 10 percent and preferably greater than 20 percent. Preferably the yarn has a bundle crimp elongation of 20 to 45 percent when measured as defined subsequently.

The examples illustrate production of yarns wherein, after treatment by relaxation in heat and moisture, the yarn has about 2 to 6 turns per inch of twist, a uniform appearance and a lustrous surface substantially free from protruding filament loops.

Yarns of this invention are prepared from a feed yarn of continuous thermoplastic multifilaments which have an average of at least 4 crimps per inch of filament (158 crimps/meter) when relaxed in heat and moisture. Hot-jet-crimped filaments of types disclosed in Breen and Lauterbach U.S. Pat. No. 3,543,358 are preferred. Gear crimped or stuffer-box crimped filaments can also be used. Alternatively, the feed yarn may be composed of filaments which crimp spontaneously when heat-relaxed, e.g., bicomponent filaments.

The feed yarn is preferably fed at an overfeed of 2 to 15 percent through a forwarding jet device wherein at least three jets of compressible fluid, heated to a temperature which will plasticize the filaments, are impinged laterally against the yarn from different directions to entangle the filaments throughout the length of the yarn. The yarn is then forwarded from the entangling jets through a false-twist, heat-setting operation wherein the yarn is twisted to about 1 to 30 turns per inch (40 to 1180 turns/meter) by a false-twister, is heated and cooled while twisted to set latent twist in surface filaments of the yarn without removing entanglement from filaments inside the yarn bundle, and is then untwisted.

The above false-twister is preferably a torque jet supplied with compressible fluid, and the tension on the yarn during latent twist-setting is about 0.01 to 0.05 grams per denier. Preferably the yarn is twisted to about 3 to 12 turns per inch (about 118 to 470 turns/meter) by the torque jet false-twister.

The yarn of this invention can be tufted, knitted or woven directly into a pile fabric without any substantial amount of twist or torque in the yarn. The yarn then develops twist and increases in diameter during fabric finishing to give coherent, bulky twisted tufts equivalent in appearance to conventional singles twisted yarn.

In production of cut-pile carpets, the pile is preferably cut, and twist then developed in the tufts by steaming and agitation of the pile. The dyeing process used may be sufficient to develop the twist.

DETAILED DESCRIPTION OF THE INVENTION

Figure 1:
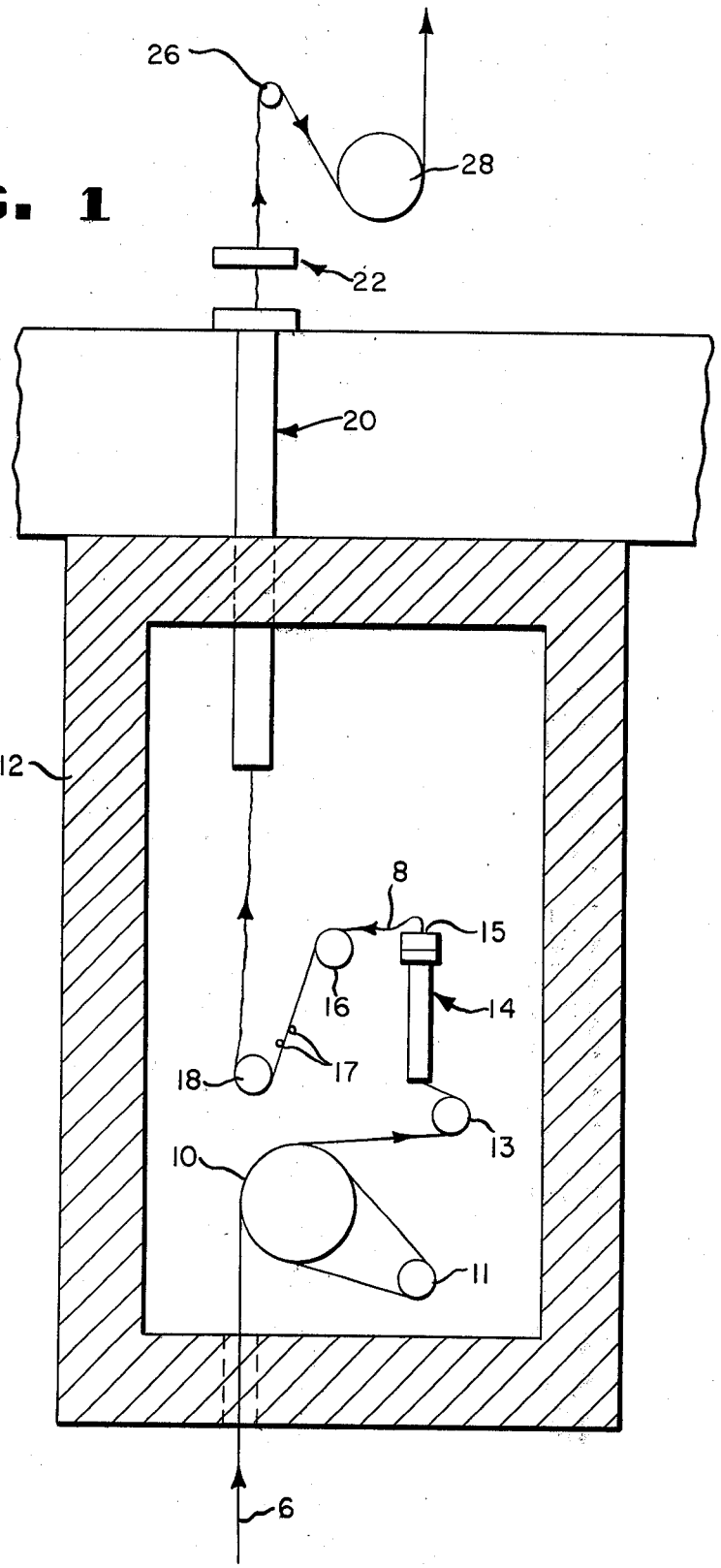
FIG. 1 is a schematic elevational view, partly in section, of an apparatus arrangement suitable for use in the process of this invention.

The products of the invention have a desirable balance of high bulk, high coherency and latent twist. The bulk is contributed by the filament crimp which should be at least 4 crimps per inch (158 per meter). A latent twist of about 2 to 6 tpi (about 80 to 240 turns/meter) is preferred for most uses where straight tuft appearance is desired. A curly kinky tuft appearance useful in certain carpet constructions is obtained at higher values up to about 10 tpi (394 turns/meter). The yarn when wound on the package has substantially no net twist and low torque, so that the yarn performs equivalently to nontwisted yarns in tufting, knitting or weaving operations. However, when the yarn is made into pile fabric and the fabric is treated by heat and moisture, the tufts twist while shrinking in length, typically by about 8 to 20%, and expand in diameter. This can be seen in FIG. 2, where 2A represents a cut tuft of griege yarn before heat treatment and 2B represents the same tuft after heat treatment. The finished fabrics are characterized by round distinctive tufts of excellent coherency, luster and luster contrast. The twisting both straightens the surface filaments and makes them more nearly parallel to one another in helical paths around the yarn axis. This increases the surface luster and provides the desired appearance.

Furthermore, the self-twisting tendency persists in cut-pile fabric during wear, so that the cut-pile of a carpet, for example, tends to maintain its twist. This is due in part to yarn torque and in part to the higher cohesion of these yarns due to entanglement. In contrast, a conventional twist-set yarn tends to untwist and lose cohesion during wear.

During twist development, each tuft expands in diameter because of crimp development. The increase in yarn bundle diameter is greater than 10% in the test described below. Preferably the increase in yarn bundle diameter is greater than 20%.

The high coherency of this yarn is due to filaments which pass transversely through the bundle and are entangled with other filaments. A high coherency is needed so that filaments will not separate from one tuft and twist with a neighboring tuft during fabric finishing. On the other hand, the coherency should not be so high that it impedes an increase in yarn bundle diameter. A preferred lateral coherency range is 0.8 to 2.0 inches (2.0 to 5.1 cm.) as measured in the test described subsequently. After development of the twist, the final tuft coherency is due to a combination of coherency due to transverse filament entanglement and coherency contributed by the twist.

A preferred product of this invention has the bulk, coherency, and latent twist properties described above and, in addition, has a surface substantially free from protruding crunodal (ring-like) filament loops. Yarn having projecting crunodal loops generally must be wound on a cone or have a wax finish applied in order to reduce snagging and allow satisfactory package delivery. An additional advantage of substantially loop-free yarn is seen during twist development in the fabric. When a pile fabric of dense construction is made from yarn with many surface loops, these loops tend to tangle with loops of adjacent tufts and prevent the twist from developing fully and uniformly during carpet finishing. When the yarn surface is substantially free from protruding loops, the tufts are free to develop their maximum twist uniformly with minimum interference.

Although yarns of this invention are used primarily in cut pile, a shag type fabric may be made with long loop pile and then when the fabric is heat-treated, recovery of the latent twist in the yarn of this invention will form twist-doubled loops wherein the two legs of the loop twist about each other, leaving a small bend at the tip of the loop. For such use, yarns with a higher degree of latent twist are preferred.

Polymeric filaments of materials such as polyamide, polyester, polypropylene, acrylic, modacrylic and triacetate, which are thermoplastic at least in their crimp and twist setting behavior, are generally suitable for products of the invention, though adjustments of the processing conditions may be necessary to accommodate the different responses of such materials to heat, tension, etc.

Deniers of yarns commonly used for pile fabric such as upholstery or carpets are normally in the range of 500 to 5,000.

Although single yarns are used for saxony and shag types of carpets, multiple yarns may be employed. A piled appearance may be obtained by feeding two or more yarns of different color or dyeability to the process. Conductive filaments may be entangled with nonconductive filaments, in which case the conductive filaments are preferably longer than the nonconductive filaments after entangling so that the conductive filaments will migrate back and forth through or wrap around the bundle more frequently than the others and will appear at the bundle surface more often where they more effectively conduct away electrostatic charges.

In a preferred embodiment of the process of the invention disclosed in FIG. 1, feed yarn 6 is taken from a suitable supply source and passes around driven feed roll 10 and separator roll 11 which are housed in enclosure 12. Either roll 10 or enclosure 12, or both, may be heated. The yarn then passes around guide roll 13 and into entangling jet assembly 14 where jets of steam or other hot gas entangle the filaments. The yarn is fed into the jet at a faster rate than the take-away rate to provide an overfeed of 2% to 15%, which makes it possible for the filaments to entangle in the gas jets. A low overfeed of about 4% or 5% is usually desirable. However, if a feed yarn has unusually high shrinkage, an overfeed greater than 15% may be needed to give adequate entanglement. The preheated, entangled and crimped yarn 8 is pulled sideways away from the jet exit 15 at low tension to roller 16, pins 17 and roller 18 which together increase tension on the yarn in the next step and act as a twist trap. Yarn 8 then proceeds through heater 20, cools beyond the outlet of heater 20, and enters twister 22 for false-twisting of the yarn, the twist running back along the yarn through heater 20 to roller 18. Yarn 8 then untwists as it leaves the false-twisting device and passes via roller 26 to driven takeup roller 28 and then to a windup (not shown) and is wound on a package.

Since the yarn is overfed to the entangling jet device, a jet-forwarding action is used to maintain uniform flow of yarn through the device. A forwarding action is provided by having most of the jetted gas leave the device in the direction of yarn movement. It is also important, particularly at yarn speeds over 100 ypm. (109 meters/minute), to have the yarn approximately centered in the jetted gas. This is most easily accomplished by having three or more jet orifices spaced equally around the yarn. If the yarn were allowed to move intermittently into and out of a jet stream, the result would be an intermittent non-uniform entanglement of filaments along the length of the yarn, rather than the continuous uniform entanglement which characterizes the products of this invention.

Figure 3:
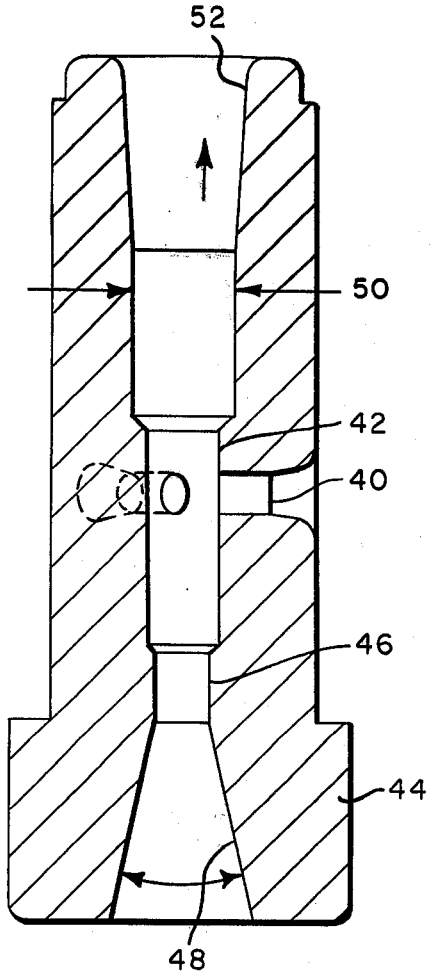
FIG. 3 is a side sectional view, on an enlarged cross section scale, of a preferred form of jet insert forming part of the entangling jet 14 indicated in FIG. 1, the cross section being taken along the axis of the yarn passageway.

The jet insert shown in FIG. 3 is suitable for entangling the yarn filaments by approximately transverse impingement of steam or hot air on the yarn filaments; a forwarding action is provided by the difference in diameters of the yarn entrance and exit. A preferred embodiment of this jet insert is described in Example I. The jet insert is supplied with steam or hot air at a pressure generally in the range of 40 to 150 psig. (2.81 to 10.5 kg./cm.$^2$). Temperatures of about 140°C. or greater are generally suitable for entangling 6—6 nylon filaments. The overfeed through the jet insert, which is governed by the difference in speeds between feed roll 10 and takeup roll 28, is preferably as low as will give the desired coherency, in order to avoid objectionable surface loops of filaments.

A fluid torque jet of the type disclosed in Breen et al. U.S. Pat. No. 3,079,745, wherein compressed fluid enters a yarn passage approximately tangentially, is preferably used for false-twisting the yarn, although useful products can also be made by mechanical twisters. The distance from the end of the heater 20 to the false-twister 22 is preferably about 1 to 6 inches (2.54 to 15.2 cm.), which gives high twist yarn and provides a dampening effect on wave patterns generated in the yarn. The highest twist region is closest to the false-twister, so a lower heat-set twist results when the distance from the heat-setting tube to the false-twister is increased. The fluid should preferably be compressed air at ambient temperature, in which case, the portion of the air which passes upstream cools the approaching yarn in the twisted configuration.

The entangling jet is capable of entangling the yarn filaments at extremely high speeds. The torque jet is also capable of processing yarn at high speeds to provide a desired amount of false twist, but yarn speeds are limited by the rate at which proper twist setting can be accomplished due to limited heat transfer. Since the entangling jet heats the yarn uniformly, coupling the entangling and twist-setting operations closely together permits the operation to be run at speeds higher than could be accomplished by the heat-setting alone. To further conserve heat in the yarn, the temperature of the atmosphere within enclosure 12 may be elevated by insulation or by auxiliary heating. By such means, the yarn residence time in the heat-setting step may be as low as 7 milliseconds. Further energy conservation can be achieved by coupling spinning, drawing and crimping steps with the entangling and twist-setting operations.

Heater 20 may be any of the conventional types e.g. a radiant heater, but is preferably a type wherein hot air or steam impinges on the yarn near the middle of the tube and then travels parallel to the yarn in both upstream and downstream directions. The diameter of the tube is preferably small in relation to its length and the ends may be further restricted to maintain pressure in the setting zone.

In general, it is preferred that the yarn be exposed to a temperature and other conditions in the heater which are sufficient to plasticize at least the surface filaments and effect a permanent twist memory in them but which minimize crimp removal from filaments inside the yarn bundle. Some conditions which influence penetration of heat into the yarn are the degree of twist, higher twist inhibiting penetration; and the degree of crimp in the yarn, and the pressure of the hot fluid impinging on the yarn, higher crimp and pressure promoting penetration. When the filaments are polymers which are plasticized by water as well as heat, such as nylon 6 and 66, it has been found that dry gas or superheated steam penetrate less than wet steam. Higher temperatures may be needed with dry heat. Radiant heat, in general, affects only the surface filaments.

The degree of twist in the twist-setting zone may be 1 to 30 turns per inch (40 to 1180 turns/meter) but about 3 to 12 turns per inch (118 to 472 turns/meter) are preferred for yarn deniers in the range used for pile fabrics. The higher twists are used for lower yarn deniers. Generally, the twist level in the twist-setting zone is roughly twice the degree of recovered twist desired in the final pile fabric. When an air torque jet is used as the twisting means, the air pressure may be adjusted to achieve the desired degree of twisting. The tension on the yarn in the twist-setting zone should be sufficient to prevent twist doubling but not so high as to destroy the entanglement or remove all of the crimp. A tension in the range of about 0.01 to 0.05 grams per denier is suitable.

Feed yarn 6 preferably has low coherency, because too much entanglement in the feed yarn prevents the filaments from separating for uniform heating and entangling in the entangling process. Alternatively or additionally, yarn having slightly too much entanglement may be made satisfactory by passing it under tension in one or more bends around one or more cylindrical pins which tend to flatten the bundle and comb out excess entanglement.

Tension applied to yarn of this invention after twisting must be regulated carefully. Excessive tension can remove too much of the entanglement which provides cohesion, therefore tensions above about 0.12 gram per denier should usually be avoided at all stages from winding through tufting. Yarn deniers of 1000 or less and those having few filaments are particularly susceptible to high tension. On the other hand, yarns having levels of cohesion suitable for tufting at usual tensions of about 0.045 to 0.06 gpd. may have insufficient bulk and increase in bundle diameter if used in woven pile fabric, for example, where the weaving tension is low. In such cases, higher tension may be applied to the yarn before or during weaving, or a yarn may be made with lower cohesion particularly for this use. Tensions should be controlled uniformly along each yarn, and from yarn to yarn, when a uniform tuft appearance is desired in the final fabric. On the other hand, tension may be varied intentionally along each yarn, or from yarn to yarn, where pattern effects are desired.

The degree of twist which develops during finishing of pile fabric made from yarns of this invention depends to some degree on the amount of agitation or mechanical working which the fabric receives during hot treatments such as scouring or dyeing. For example, when the beck dyeing process which agitates the fabric is employed, a yarn having 2–4 tpi (79 to 157 turns/meter) of latent twist may be used, whereas a yarn having 3–6 tpi (118 to 236 turns/meter) of latent twist may be needed to give the same degree of twist in the final fabric when a continuous dyeing process, such as Kuesters, is used which gives little mechanical working. Alternatively, an optimum degree of twist development may be obtained in the pile of fabrics, without mechanical working, by heat-treating the fabric before dyeing, preferably with steam, to develop a major portion of the twist, the remainder of the twist being developed during dyeing. Such heat-treating may be done in horizontal preferably on the pile side of the fabric or vertical steamers, or with a steaming shoe. The fabric may be either wet or dry prior to heat treatment. When fabrics are to be printed rather than dyed, the twist may be developed before printing by the above heat treatments or by boiling in a beck, e.g., for 10 minutes. Unusual color and pattern effects may be obtained by printing greige fabric before heat-treating the fabric to develop the twist.

TEST METHODS

Pull-Apart Test For Lateral Coherency

This test directly measures the lateral coherency of the yarn. Two hooks are placed in about the center of the yarn bundle to separate it into two groups of filaments. The hooks are pulled apart at 12.7 cm./min. at 90° to the bundle axis by a machine which measures the resistance to separation, such as an Instron machine. The yarn is pulled apart by the hooks until the force exerted on the total yarn bundle is as follows, at which point the machine is stopped:

| Yarn Denier | Pull-Apart Force |
|---|---|
| 140–574 | 50 grams |
| 575–1299 | 200 grams |
| 1300–5000 | 454 grams |

The distance between the two hooks is measured. The average of ten determinations is taken as the lateral coherency. The standard deviation of individual lateral coherency determinations indicates the uniformity of the entanglement throughout the length of the yarn. The standard deviation of the individual determinations (X) is calculated by the formula $$\sqrt{\frac{\Sigma X^2}{N} - \left[\frac{\Sigma X}{N}\right]^2}$$

where N is the number of determinations. The test yarn lengths should be at least 10 to 15 cm. long, taken randomly.

BUNDLE CRIMP ELONGATION (BCE)

BCE is determined on yarn which has been treated as follows: A 100–105 cm. length of yarn is put into a water bath and boiled at about 100°C. for three minutes. The yarn is rinsed in cold water and dried at 100°–110°C. for 1 hour, all under a relaxed condition. The yarn is conditioned at 72% relative humidity for 2 hours. A 55 cm. length of yarn is fastened to a clamp on the upper end of a 150 cm. vertical board. Fifty centimeters below the upper clamp, a second weighted yarn clamp is hooked to the board, the total weight of the second clamp assembly being 0.08 to 0.12 gpd.

The yarn is attached to the second clamp, which is then unhooked and lowered gently and allowed to hang at the end of the yarn for three minutes. At this time, the extended length is measured. The percent BCE is calculated by multiplying the increase in length by two. BCE is the average of three measurements.

CRIMPS PER INCH (CPI)

The yarn is boiled and conditioned as described above. A section of yarn in a relaxed condition is cut to two inches (5.08 cm.). A single filament is taken from this yarn section and clamped at the ends between two clamps two inches apart. The clamps are mounted over a piece of black cloth to facilitate counting the crimps. Only significant crimps readily visible at low magnification are counted. A crimp is defined as one complete crimp cycle or sine wave. The crimps/inch are calculated by dividing the number of crimps for a single filament by two. Because of the random nature of the three-dimensional crimp, some judgement must be exercised in determining the significant crimp. Look for abrupt changes in the direction of the filament. CPI is the average of three measurements.

MEASUREMENT FOR LATENT TWIST

This test measures the amount of twist that is recovered when a false-twist/set sample is subjected to saturated steam. Apparatus consists of a black felt marking pen suitable for marking the yarn, a twist counter, weights to load the yarn on the twist counter to approximately 0.01 gpd. (e.g., 30 gms. for 3,000 ± 150 denier and 55 gms. for 5,500 ± 275 denier), scissors, and a steam source.

Before yarn segments are cut from the package, the yarn is held taut and marked on one side with the marking pen. Three 8–10 inch (20 to 25 cm.) marked segments are cut. About 4–6 feet (1.2 to 1.8 meters) of the yarn are discarded between segments. Each segment is treated in atmospheric steam by holding one end of the segment at a time in the steam plume for 20–30 seconds. The free end of the segment is agitated while steaming. The other end of the segment is then held and the treatment is repeated for 20–30 seconds. The twist counter is set for a 6-inch (15.2 cm.) sample. The sample is mounted in the twist counter, tensioned to 0.01 gpd. and untwisted by observing the mark until a helix disappears or on an average becomes a straight line. The average twist in turns per inch (per m.) is computed for the three yarn segments.

MEASUREMENT OF INCREASE IN YARN BUNDLE DIAMETER

Ten three inch (7.6 cm.) yarn segments are selected from a yarn package after the outside layer has been discarded. The yarn segments are placed in a microfilm reader or slide projector to magnify their size 10–20X. The holder should not flatten the yarn. The diameter of these yarn segments is measured at four places along their lengths and an average value is calculated as a segment diameter. The yarn diameter ($D_0$) is the average diameter of ten yarn segments.

The yarn is then tufted into a 3.5 oz./yd.$^2$ (0.12 kg./m$^2$) Typar spunbonded polypropylene backing using a standard cut-pile tufting machine to make a 35 ounce per square yard (1.2 kg./m$^2$) cut pile carpet having a finished pile height of 0.625 inch (15.9 mm.) at 5/32 gauge. During tufting, the yarn receives a tension, prior to the needle, of approximately 0.04–0.07 gram per denier. The tufted sample is then steamed for 6 to 8 minutes, rinsed in cold water, gently wrung out or centrifuged to remove excess water and then dried at approximately 95°C. After drying, random tufts are cut free from the face of the backing and their diameter, $D_2$, is measured as above. Increased bundle size is calculated as follows:

$$\frac{D_2 - D_0}{D_0} \times 100$$

MEASUREMENT OF PROTRUDING FILAMENT LOOPS

Figure 2A:
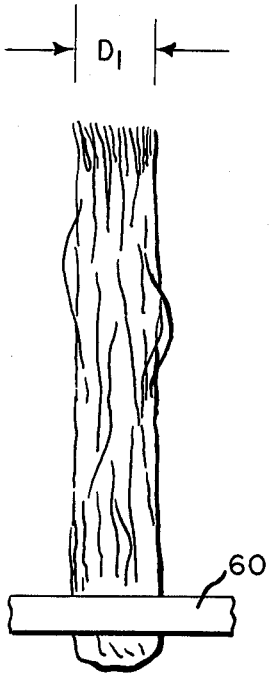
FIG. 2 shows a yarn of this invention tufted into a backing 60, before and after development of the latent twist.
Figure 2B:
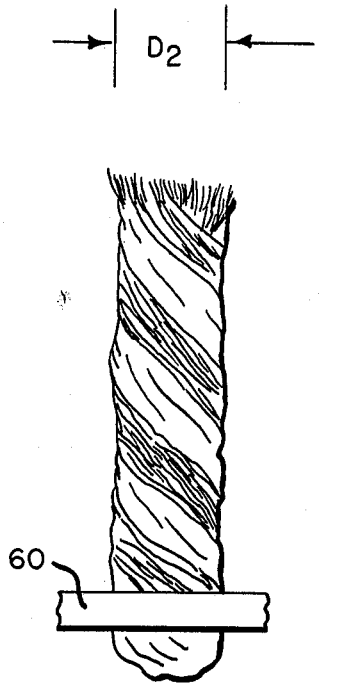

A ten-inch (25.4 cm) piece of yarn taken directly off a package is laid on a black background and any filament loops protruding more than ½ bundle diameter along one side of the bundle are counted. Loops containing one or more filaments, but less than 5 percent of the filaments in the yarn, are counted as a single loop. The number of loops counted are divided by ten to obtain the number of loops per inch. This is repeated for ten yarn samples chosen at random from the package. Loop count is the average of the ten measurements. Referring to FIG. 2A, none of the filament loops project sufficiently far from the bundle to be counted.

The following examples illustrate production of carpet yarns of this invention. The pressure and temperature conditions described are quite significant in that a little change can produce a large change in product properties.

EXAMPLE I

A bulky, coherent, continuous filament nylon yarn is prepared, using as the feed yarn a single end of 3200 denier, 15.7 dpf. 6—6 drawn nylon yarn of about 55 to 57 RV composed of trilobal filaments having a modification ratio of 2.3, and which contains 0.4% of a standard finish. It has been previously hot-jet crimped as disclosed in Example XXII of Breen et al., U.S. Pat. No. 3,186,155 to have the following properties: a bundle crimp elongation (BCE) of 46.0%, a 2.90 gm./denier tenacity, an elongation of 47.5%, an initial modulus at 10% elongation of 8.41 gpd. and an average of 8 crimps per inch of filament.

A jet insert 44 shown in FIG. 3 is used to entangle the yarn. The primary jet-stream conduits 40 have a diameter of 0.055 inch (1.40 mm.). The axes of the three fluid orifices are in a plane perpendicular to the yarn passageway, and are equally spaced at 120° angles from each other. The centerlines of the orifices pass through the same point within 0.001 inch. Yarn entrance 48 is conical with an included angle of 24° and an axial length of 0.25 inch (6.35 mm.). Restriction 46 has a diameter of 0.076 inch (1.93 mm.) and a length of 0.09 inch (2.3 mm.). Yarn treatment passage 42 has a diameter of 0.098 inch (2.49 mm.) and a length of about 0.29 inch (7.4 mm.). The axes of orifices 40 intersect the axis of the yarn passage 0.562 inch (14.3 mm.) from the entrance end of insert 44. Exit passage 50 has a diameter of 0.140 inch (3.56 mm.) and length 0.24 inch (6.1 mm.). The remainder of the yarn exit passageway has a 7° expanding taper. The total length of insert 44 is 1.12 inch (28.4 mm.).

The apparatus arrangement is of the type shown in FIG. 1. The feed yarn is placed on horizontal creels and strung into enclosure 12 at constant tension of about 50 gms. The enclosure is 16 inches (41 cm.) long, 9.5 inches (24 cm.) wide and 8 inches (20 cm.) deep. It contains one motor driven 3.5-inch (8.9 cm.) diameter roll 10 operating at 333 ypm. (302 meters/minutes) and a 1-inch (2.54 cm.) diameter separator roll, 4.5 inches (11.4 cm.) center-to-center, on which the yarn is wound with four wraps. The yarn is then passed around a second 1-inch (2.54 cm.) diameter roll positioned such that the yarn is fed at 90° into a tube 5.38 inches (13.7 cm.) long having an inside diameter of 0.085 inch (2.16 mm.) which leads the yarn to the inlet of jet insert 44. As the yarn is pulled away from the top of the jet at a 90° angle, it forms a U-shaped "roostertail" bend at the jet exit. The jet is supplied with saturated steam at 59 psig. (4.5 kg./cm.$^2$) at 153°C.

The yarn passes around two more rollers and enters axially into a 5.38 inch (13.7 cm.) long heat-setting tube 20. The yarn passageway in this tube is 0.090 inch (2.29 mm.) diameter for the first 0.25 inch (6.35 mm.), whereupon it expands to diameter of 0.25 inch (6.36 mm.) for a distance of 4.63 inches (118 mm.), then narrows to 0.076 inch (1.93 mm.) diameter near the exit end of the tube. It is supplied superheated steam through a 0.25-inch (6.35 mm.) diameter conduit perpendicular to the passageway axis and 1.43 inches (36.3 mm.) from the exit at a pressure of 60 psig. (4.22 kg./cm.$^2$) and 220°C. Twist in the yarn is about 6 to 6.5 tpi. (236 to 256 turns/meter) The yarn leaving the tube enters an air torque jet set 6 inches (15.2 cm.) above the heat-set tube exit and on the same axis as the heat-set tube. This jet is supplied with ambient air at 29 psig. (2.04 kg./cm.$^2$) which has a dual purpose: to twist the yarn and to cool it. The yarn is maintained at a tension of 50 to 75 grams in the twist zone, with the speed of take-up roll 28 being such that there is a 5% overfeed of the yarn through jet assembly 14. The treated yarn is wound up at a nominal tension of 200 grams.

The resulting yarn is 3276 denier under a 280 gm. weight, with a BCE of 31.3% (300 gram weight), an average of 6.5 crimps per inch of filament (256 per meter), a lateral coherency of 1.46 inches (37.1 mm.), a standard deviation of 0.3, a latent twist of 3.2 tpi. (126 t./m.), and an increase in yarn bundle diameter of 23%. The yarn is tufted to make a 35 oz./yd.$^2$ (1.2 kg./m$^2$) cut pile carpet having a finished pile height of 0.625 inch (15.9 mm.) at 5/32 gauge with a commercial spunbonded backing. The carpet is exposed for 8 minutes to saturated steam at atmospheric pressure and then dyed in a Kuesters dyer. The individual tufts in the finished carpet are twisted and have a lustrous appearance. The carpet shows acceptable tuft definition after 16,000 cycles in a floor wear test. The floor testing procedure is similar to that described in U.S. Pat. No. 3,611,698. The latent twist can be reduced to approximately 2.4 tpi. (94 t./m.) if the sample is to be beck dyed because the increased working of the fabric in the beck dyeing operation aids twist development.

EXAMPLE II

A bulky, coherent, continuous filament polyester yarn is prepared, using the equipment of Example I. The entangling jet assembly 14 is as described in Example II of Horn et al. U.s. Pat. No. 3,611,698, column 6, lines 1–27. The feed yarn is a single end of 2500 denier, 136 filament, zero twist, polyethylene terephthalate yarn. It has been previously hot-jet crimped by a method similar to that of Example XXII of Breen et al. U.S. Pat. No. 3,186,155 to have the following properties: a BCE of 64.1%, a tenacity of 2.60 gpd., an elongation of 60.9%, an initial modulus 7.15 gpd., and an average of 10.7 crimps per inch of filament. The entangling jet device is supplied with steam at 162°C. and 80 psig. (5.62 kg./cm.$^2$). The temperature in the enclosure is about 25°C. The yarn is wrapped four times on the feed roll which runs at a surface speed of 150 yards/minute (137 meters/minute). The take up roll speed is 135 ypm. (123 meters/minute), resulting in an overfeed of about 11%. The yarn is maintained at a tension of 50 to 75 grams in the twist zone. The heat-setting tube is supplied with steam at 141°C. and 40 psig. (2.81 kg./cm.$^2$). Twist in the yarn is about 10 to 11 tpi. (394 to 433 turns/meter). The torque jet is supplied with air at ambient temperature and 26 psig. (1.83 kg./cm.$^2$). The treated yarn is wound up at 125 grams tension.

The resulting yarn has a denier of 2730 under a 280 gram weight. The lateral coherency is 0.75 inch (1.91 cm.) with a standard deviation of 0.2. The bundle crimp elongation (BCE) is 31.2% (300 gram weight), and there are an average of 4.5 crimps/inch (177 per meter). Latent twist is 5.2 tpi. (204 t/m) with an increase in yarn bundle diameter of 46%.

EXAMPLE III

A bulky, coherent, continuous acrylic bicomponent filament yarn is prepared. The filaments of the feed yarn are composed of two acrylic polymers having different shrinkages, and develop an average of 12.4 crimps per inch of filament when the yarn is exposed to steam or heat. Two ends of 1000 denier, 166 filament, zero twist, unbulked feed yarn are fed to the equipment of Example I. The entangling jet assembly of Example II is used; it is supplied with steam at 173°C. and 110 psig. (7.73 kg./cm.$^2$). The temperature in the enclosure is approximately 25°C. The yarn is wrapped ten times on the feed roll which runs at a surface speed of 150 ypm. (137 meters/minute). The take-up roll speed is 140 ypm. (128 meters/minute), resulting in an overfeed of about 7%. The yarn is maintained at a tension of 50 to 75 grams in the twist zone. The heat-setting tube is supplied with steam at 142°C. and 40 psig. (2.81 kg./cm.$^2$). Twist in the yarn is about 5.5 tpi. (216 turns/meter). The torque jet is supplied with air at ambient temperature and 18 psig. (1.26 kg./cm.$^2$). The yarn is wound up at 125 grams tension.

The resulting yarn has a denier of 2298 under a 280 gram weight. Lateral coherency is 1.14 inch (2.90 cm.) with a standard deviation of 0.4. The bundle crimp elongation (BCE) is 72.1%, and there are an average of 8.1 crimps per inch (320 per meter). Latent twist is 2.6 tpi. (102 t/m) with an increase in yarn bundle diameter of 80%.

We claim:

1. A coherent yarn of continuous thermoplastic multifilaments which have an average of at least 4 crimps per inch of filament when relaxed in heat and moisture and are highly entangled throughout the length of the yarn, the yarn having a lateral coherency of 0.2 to 2.8 inches with a standard deviation of less than 0.5 times the average value, and a latent twist of 0.75 to 10 turns per inch which is recoverable by relaxation of the yarn in heat and moisture, there being an increase in yarn bundle diameter of greater than 10 percent when recovering latent twist after tufting.

2. A yarn as defined in claim 1 characterized by having a surface substantially free from protruding filament loops.

3. A yarn as defined in claim 1 wherein the lateral coherency is 0.8 to 2.0 inches.

4. A yarn as defined in claim 1 wherein the latent twist is 2 to 6 turns per inch.

5. A yarn as defined in claim 1 wherein said increase in yarn bundle diameter is greater than 20 percent.

6. A yarn as defined in claim 1 wherein the steam-relaxed yarn has a bundle crimp elongation of 20 to 45 percent.

7. A yarn as defined in claim 1 wherein the steam-relaxed yarn has from 2 to 6 turns per inch of twist, a uniform appearance and a lustrous surface.

8. The process of preparing a coherent yarn from a feed yarn of continuous thermoplastic multifilaments which have an average of at least 4 crimps per inch of filament when relaxed in heat and moisture, which comprises feeding the feed yarn at an overfeed of 2 to 15 percent through a forwarding jet device wherein at least 3 jets of compressible fluid heated to a temperature which will plasticize the filaments are impinged laterally against the feed yarn from different directions to entangle the filaments throughout the length of the yarn, and forwarding the yarn from the entangling jets through a false-twist, heat-setting operation wherein the yarn is twisted to about 1 to 30 turns per inch by a false-twister, is heated and cooled while twisted to set latent twist in surface filaments of the yarn without removing entanglement from filaments inside the yarn bundle, and is then untwisted.

9. A process as defined in claim 8 wherein the false-twister is a torque jet supplied with compressible fluid and the tension on the yarn during latent twist-setting is about 0.01 to 0.05 grams per denier.

10. A process as defined in claim 9 wherein the yarn is composed of nylon filaments.

11. The process of preparing a coherent yarn from a feed yarn of continuous thermoplastic multifilaments having an average of at least 4 crimps per inch of filament which comprises feeding the feed yarn at an overfeed of 2 to 15 percent through a forwarding jet device wherein at least 3 jets of compressible fluid heated to a temperature which will plasticize the filaments are impinged laterally against the feed yarn from different directions to entangle the filaments throughout the length of the yarn, and forwarding the yarn from the entangling jets through a false-twist, heat-setting operation wherein the yarn is twisted to about 3 to 12 turns per inch by a false-twister, is heated and cooled while twisted to set latent twist in surface filaments of the yarn and minimize crimp removal from filaments inside the yarn bundle, and is then untwisted to produce a yarn which develops twist and crimp simultaneously when relaxed in heat and moisture.

* * * * *